US008584887B2

(12) United States Patent
Segal

(10) Patent No.: US 8,584,887 B2
(45) Date of Patent: Nov. 19, 2013

(54) TAMPER EVIDENT CONTAINER UTILIZING SEALED INTERFACE BETWEEN CONTAINER AND LID

(76) Inventor: Alexander Segal, Richmond Hill (CA)

( * ) Notice: Subject to any disclaimer, the term of this patent is extended or adjusted under 35 U.S.C. 154(b) by 0 days.

(21) Appl. No.: 12/925,683

(22) Filed: Oct. 27, 2010

(65) Prior Publication Data

US 2012/0103991 A1 May 3, 2012

(51) Int. Cl.
*B65D 17/40* (2006.01)

(52) U.S. Cl.
USPC ..... 220/276; 220/780; 220/793; 220/359.2; 220/4.21; 220/359.4

(58) Field of Classification Search
USPC ..... 220/4.21, 270, 276, 359.1, 359.2, 220/359.4, 780, 793; 206/469
See application file for complete search history.

(56) References Cited

U.S. PATENT DOCUMENTS

| | | | | |
|---|---|---|---|---|
| 2,998,158 | A * | 8/1961 | Tupper | 220/276 |
| 3,229,810 | A * | 1/1966 | Goller et al. | 206/467 |
| 3,454,158 | A * | 7/1969 | Tigner | 206/471 |
| 4,474,304 | A | 10/1984 | Jacobs | |
| 4,488,658 | A | 12/1984 | Smith et al. | |
| 4,595,547 | A | 6/1986 | Herr | |
| 5,111,953 | A | 5/1992 | Faust et al. | |
| 5,115,934 | A | 5/1992 | Nelson | |
| 5,398,836 | A | 3/1995 | Luch et al. | |
| 5,553,701 | A * | 9/1996 | Jarecki et al. | 206/15.2 |
| 6,883,678 | B2 * | 4/2005 | Chou | 220/793 |
| 2003/0183636 | A1 * | 10/2003 | Shih | 220/359.1 |
| 2005/0133508 | A1 | 6/2005 | Landis et al. | |
| 2006/0006178 | A1 * | 1/2006 | Foldesi et al. | 220/276 |

OTHER PUBLICATIONS

Toensmieir, Patrick A., "In-Mold Labeling Looks to High-Output Molds for Growth", accessed Jan. 23, 2008 at www.moldmakingtechnology.com/articles/050707.html.

* cited by examiner

*Primary Examiner* — Anthony Stashick
*Assistant Examiner* — James N Smalley
(74) *Attorney, Agent, or Firm* — Alex Porat

(57) ABSTRACT

A tamper evident container (10) where the base (12) has an inverted U-shaped section (25) connected to the base sidewall (21), and an annular flange (16*a*) extending from the base inverted U-shaped section (25) such that the base annular flange (16*a*) extends in a plane generally parallel to the base bottom wall (23). The lid also features an inverted U-shaped section (45) connected to the lid top surface (43), and an annular flange (16*b*) extends from the lid inverted U-shaped section (45) such that the lid annular flange (16*b*) extends in a plane generally parallel to the lid top surface (43). The base and lid inverted U-shaped sections (25, 45) are sized such that, when mounted to one another, the base and lid annular flanges (16*a*, 16*b*) abut one another and may be bonded together to thereafter form a tearable strip.

6 Claims, 7 Drawing Sheets

TAMPER EVIDENT CONTAINER UTILIZING SEALED INTERFACE BETWEEN CONTAINER AND LID

FIELD OF THE INVENTION

The invention relates to the art of tamper evident containers.

BACKGROUND OF THE INVENTION

Tamper evident containers are ubiquitous for storing sensitive material such as drugs. Such containers typically utilize an additional ring, tab or external plastic sheathing that must be broken off by the consumer in order to access the container. Conversely, the breakage of such irreparable break-open rings, tabs or external plastic sheathing indicate that the container has been opened. Examples of such prior art is shown in U.S. Pat. Nos. 4,474,304, 4,488,658, 4,595,547, 5,111,953, 5,115,934, 5,398,836 and U.S. Pub. No. 2005/0133508.

It is desired to provide a low cost and easily manufacturable tamper evident container.

SUMMARY OF THE INVENTION

A tamper evident container is provided having a base and a lid mountable thereon. The base has a bottom wall, a base sidewall extending transverse to the base bottom wall, an inverted U-shaped section connected to the base sidewall, and an annular flange extending from the base inverted U-shaped section such that the base annular flange extends in a plane generally parallel to the base bottom wall. The lid has a surface cap, an inverted U-shaped section connected to the lid surface cap, and an annular flange extending from the lid inverted U-shaped section such that the lid annular flange extends in a plane generally parallel to the lid surface cap. The base and lid inverted U-shaped sections are sized such that, when mounted to one another, the base and lid annular flanges abut one another.

The junction between the base annular flange and the base inverted U-section preferably has a narrower cross-sectional width than the cross-sectional width of the base inverted U-section. The junction between the lid annular flange and the lid inverted U-section preferably also has a narrower cross-sectional width than the cross-sectional width of the lid inverted U-section.

The lid and base inverted U-sections preferably each have projections that together provide a deformable detent mechanism for releasably locking the lid to the base.

The base inverted preferably U-section comprises a first sidewall section, a bight section, and a second sidewall section, the base projection depending from the first base inverted-U sidewall section. The lid inverted U-section preferably comprises a first sidewall section, a bight section, and a second sidewall section, the lid projection depending from the first lid inverted-U sidewall. And the base projection preferably abuts against the lid inverted-U first sidewall causing the base inverted-U second sidewall to abut and seal against the lid inverted-U second sidewall.

A container according to claim 6, wherein the base and lid annular flanges are bonded to one another.

DETAILED DESCRIPTION OF THE INVENTION

Figure 1:
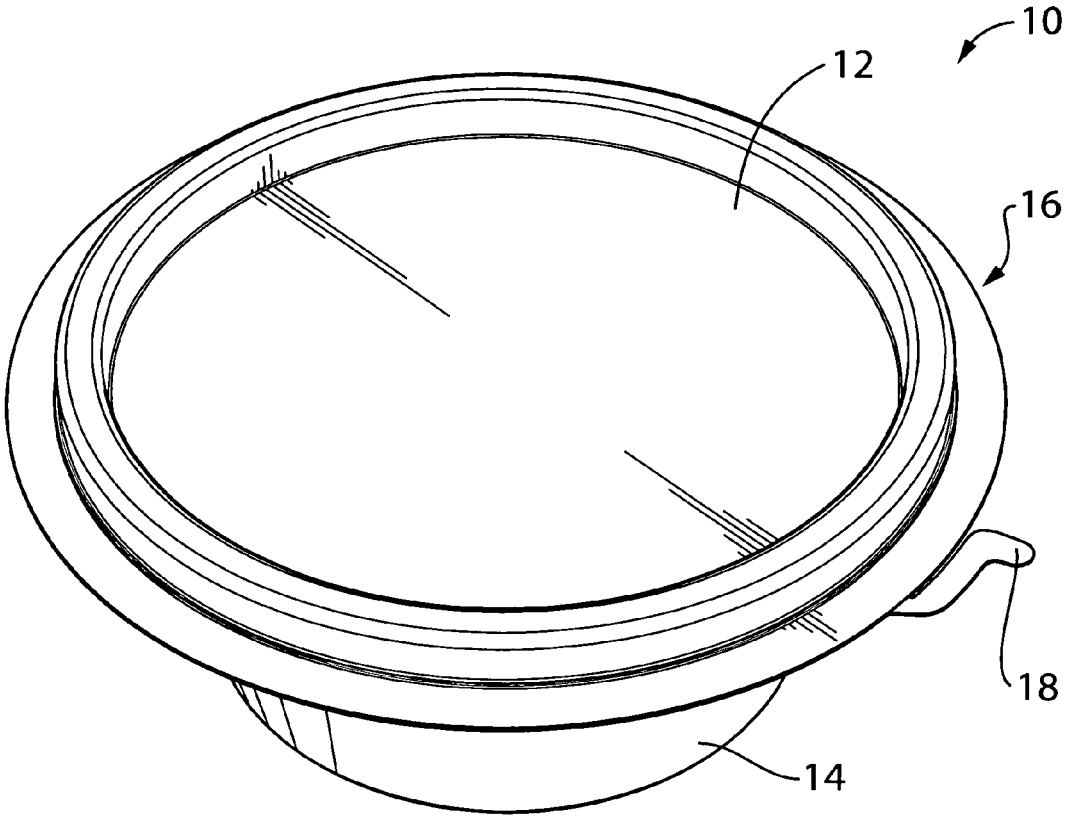
FIG. 1 is a perspective view of a container, comprising a base and lid, according to a preferred embodiment.

FIG. 1 shows the container 10 comprising removable lid 12 and base 14. The lid 12 is initially sealable to the base 14 via a sealing interface 16 which joins the lid 12 to the base 14 via two flanges adhered or bonded to one another as discussed in much greater detail below. To open the sealing interface 16, the container 10 includes a pull-tab 18 (connected to the sealing interface) which the consumer may pull upon to remove the sealing interface 16, thus enabling the lid 12 to be removed from the container. Once the sealing interface 16 is broken and removed, it cannot be repaired.

Figure 2:
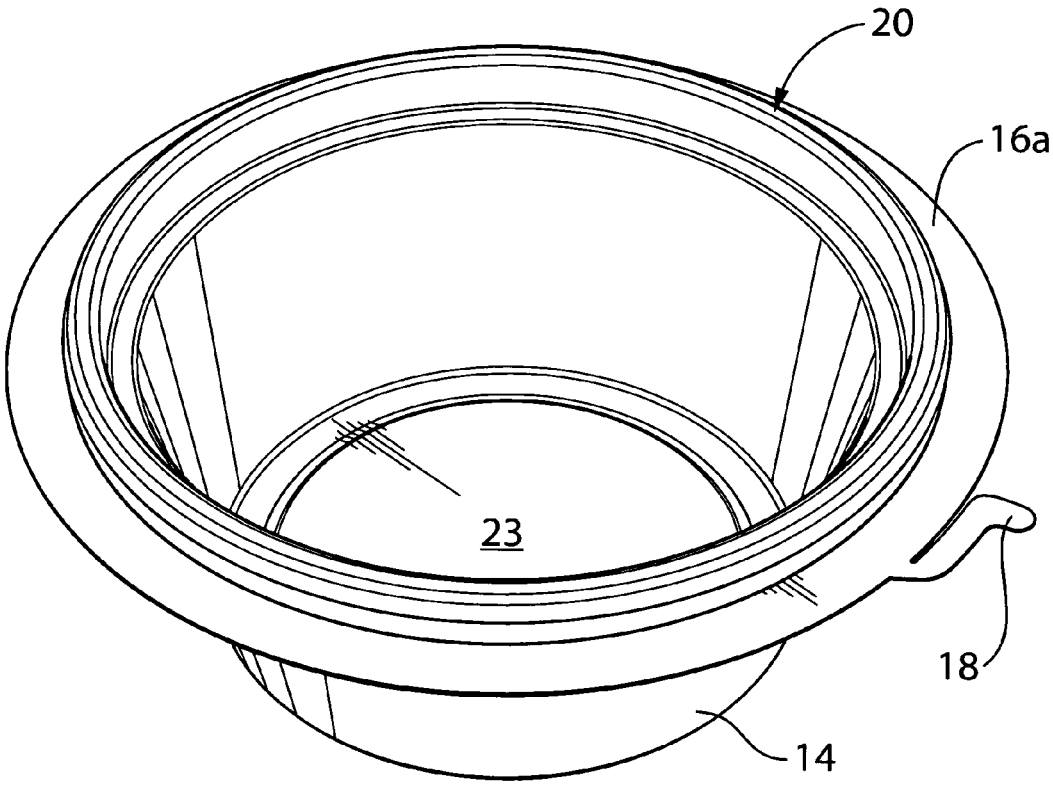
FIG. 2 is a perspective view of the base.
Figure 3:
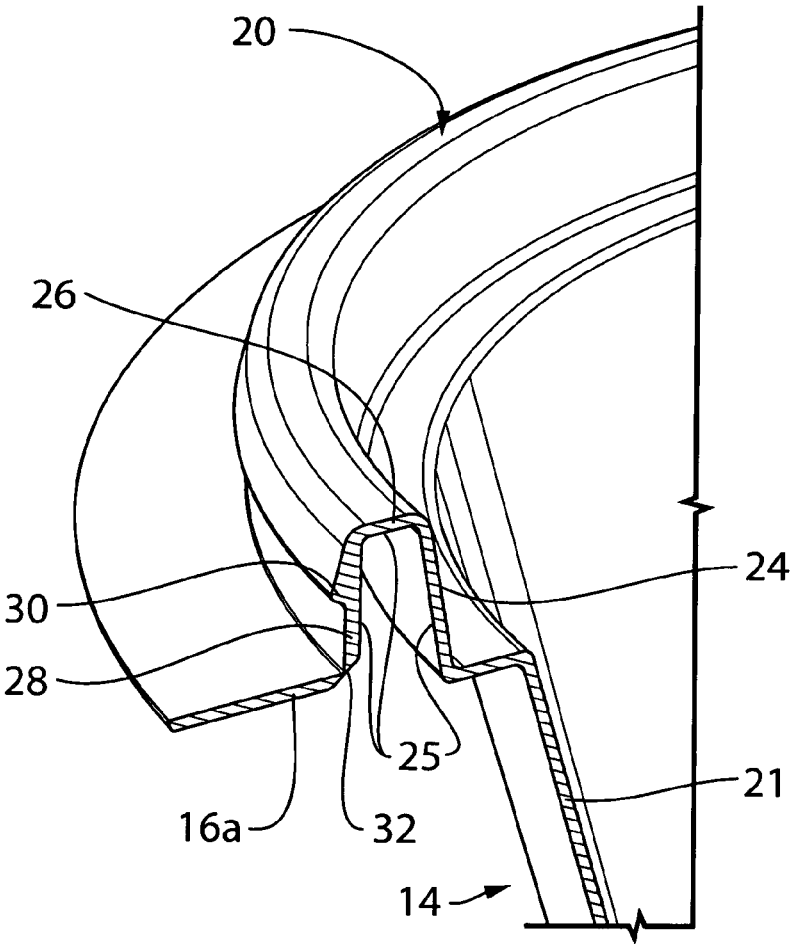
FIG. 3 is a fragmentary view of the base.
Figure 4:
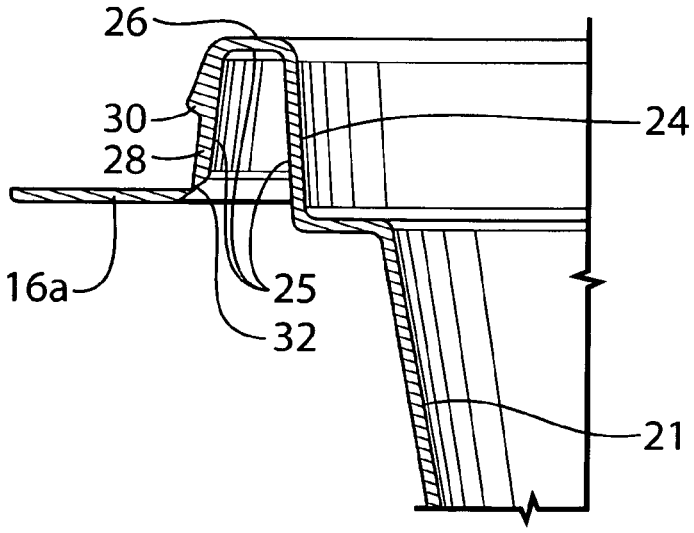
FIG. 4 is a cross-sectional view of the base.

Referring additionally to FIG. 2-4 which illustrate the base 14 in isolation, it will be seen that the base 14 includes a rim 20 from which depends a horizontally extending annular flange **16*a* forming a first portion of the sealing interface 16**.

The rim 20 provides a first part of a reusable seal for the container 10. As seen best in FIGS. 3 and 4, the base 14 includes a side wall 21 that is generally vertically orientated relative to a base floor 23, and the rim 20 extends from the side wall 21. More particularly, the rim 20 includes an annular skirt 22 extending horizontally outward from the side wall 21. An inverted U-shaped section 25, composed of a short generally vertically oriented wall 24, a short horizontally extending section 26 (forming the bight), and another short generally vertically oriented wall 28, extends from the annular skirt 22. A projection such as a promontory 30 is formed on the outer side of wall 28. The annular flange **16*a* extends horizontally outwardly from the wall 28, and the corner between flange 16*a* and wall 28 is molded or otherwise formed with an undercut so as to present a very narrow cross-sectional width at junction 32**.

Figure 5:
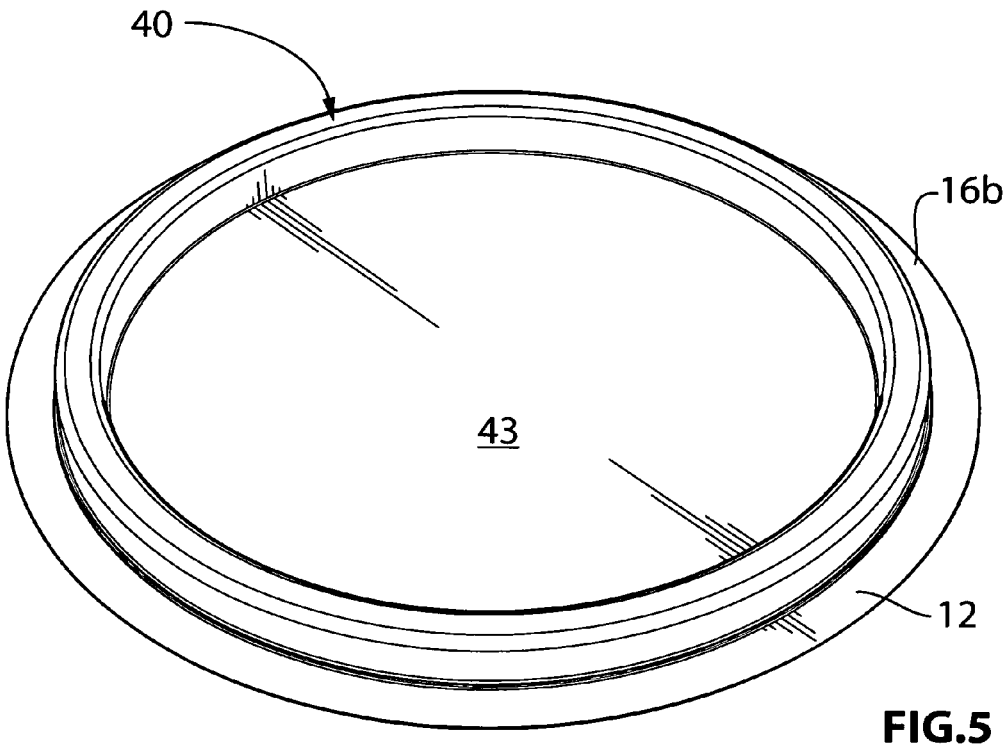
FIG. 5 is a perspective view of the lid.
Figure 6:
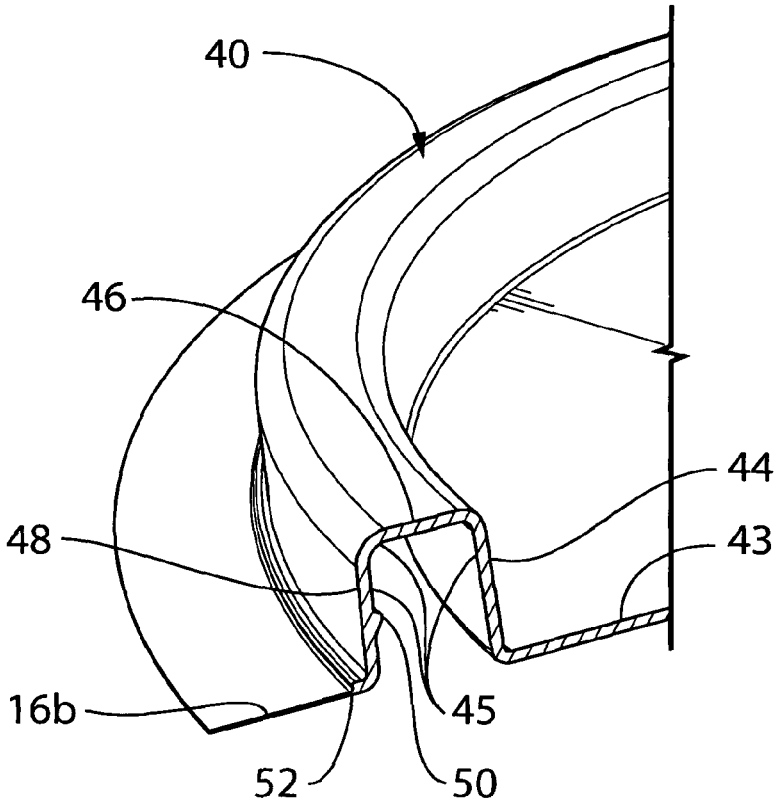
FIG. 6 is a fragmentary view of the lid.
Figure 7:
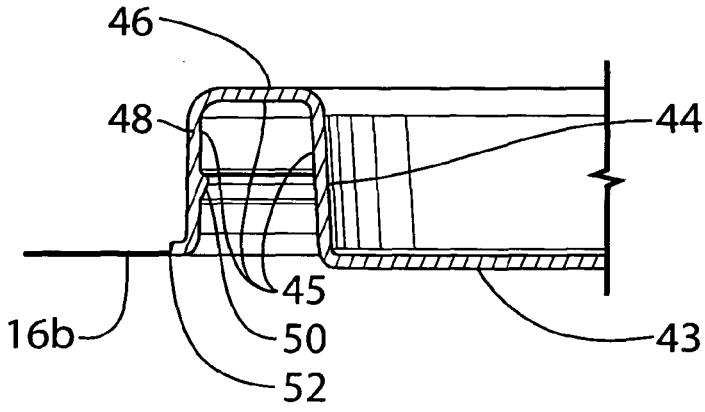
FIG. 7 is a cross-sectional view of the lid.

Referring additionally to FIGS. 5-7 which illustrate the lid 12 in isolation, it will be seen that the lid 12 includes a rim 40 from which depends a horizontally extending annular flange **16*b* forming a second portion of the sealing interface 16**.

The rim 40 provides a second part of the container reusable seal. As seen best in FIGS. 6 and 7, the lid 12 includes a generally horizontally orientated cap 43, and the rim 40 extends from the cap 43. More particularly, the rim 40 includes an inverted U-shaped section 45 composed of a short generally vertically oriented wall 44, a short horizontally extending section 46 (forming the bight), and another short generally vertically oriented wall 48. A projection such as a lip or protuberance 50 is formed on the inner side of wall 48. The annular flange **16*b* extends horizontally outwardly from the wall 48. The flange 16*b* is a relatively thin and presents a very narrow cross-sectional width at a junction 52 with the side wall 48**.

Figure 8:
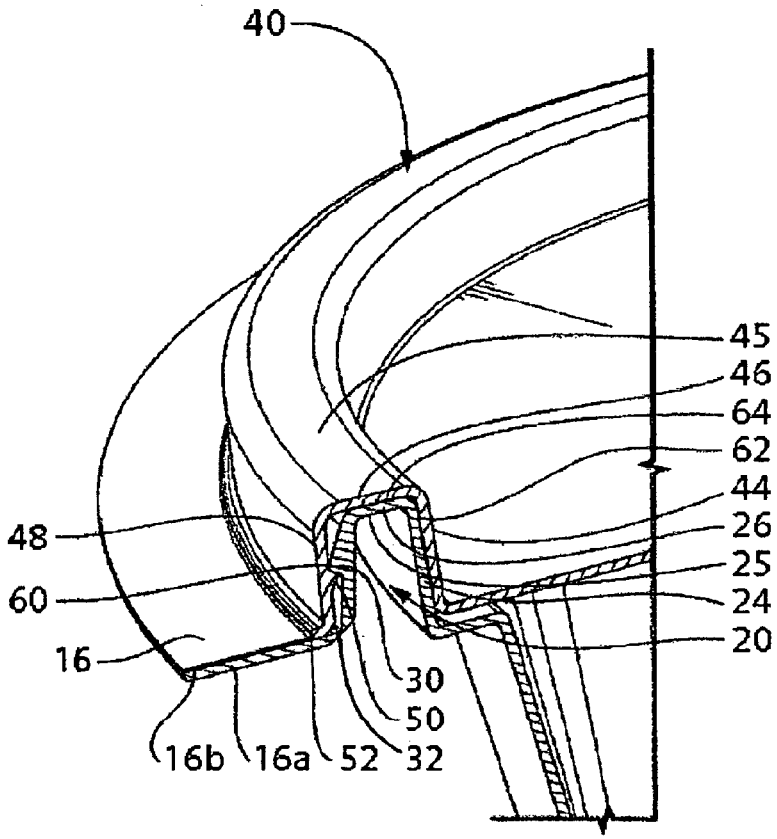
FIG. 8 is a fragmentary view of the container, with the lid mounted on the base.
Figure 9:
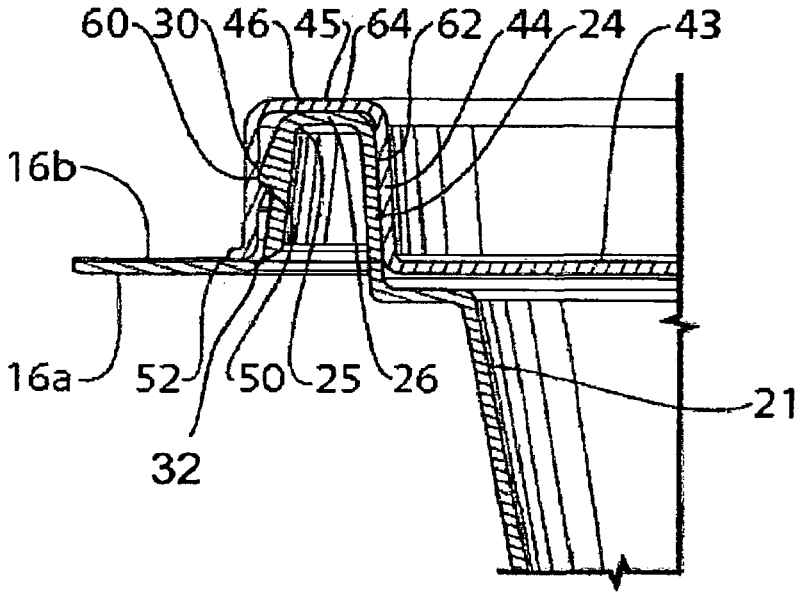
FIG. 9 is a cross-sectional view of the container, with the lid mounted on the base.

Referring additionally to FIGS. 8 and 9 which show the lid 14 mounted to the base 12, it will be seen that the lid rim 40 seats over the base rim 20, and more particularly the lid inverted U-section 45 seats over the base inverted U-section 25 such that the lid protuberance 50 sits underneath the base promontory 30, which collectively provide a detent mechanism. The lid 12 may be easily slid into this position due to the relatively flexible material such as plastic and more preferably polypropylene that is used to manufacture the container 10. Furthermore, the base inverted U-section 25 is sized to closely fit or even sized slightly larger than the lid inverted U-section 45. The base promontory 30 abuts and pushes against lid sidewall 48 so as to provide a first point of contact 60 between the base 12 and lid 12, and the resulting static reaction results in a second point of contact 62 between lid and base sidewalls 24, 44. If desired, a third point of contact 64 may also be provided between base and lid bight sections 26, 46 depending on the profiles of the base and lid rims 20, 40.

With the lid 14 thus mounted on the base 12, it will be seen that the thin lid flange 16*b* abuts the somewhat thicker base flange 16*a*. The flanges 16*a*, 16*b* may thereafter be bonded together utilizing a conventional heat press such as a heated ring, or other bonding methods may be employed as well known in the art per se such as ultrasonic welding.

As discussed above, to open the sealing interface 16, the container 10 includes a pull-tab 18 (connected to the sealing interface) which the consumer may pull upon to remove the sealing interface 16, thus enabling the lid 12 to be removed from the container. The narrow cross-sectional widths at the base and lid junctions 32 and 52, which are comparatively much thinner than the cross-sectional widths of the base and lid inverted U-section, provide easily tearable parting lines between the sealing interface 16 and the remainder of the container 10. The lid junction 52 is located radially outward of the base junction 32, which defines a corner between the base vertically oriented wall 28 and the annular flange 16*a*.

While the above describes a particular embodiment(s) of the invention, it will be appreciated that modifications and variations may be made to the detailed embodiment(s) described herein without departing from the spirit of the invention.

The invention claimed is:

1. A tamper evident container, comprising:

a base and a lid mountable thereon;

the base having a bottom wall, a base sidewall extending transverse to the base bottom wall, an inverted U-shaped section connected to the base sidewall, and an annular flange extending from the base inverted U-shaped section such that the base annular flange extends in a plane generally parallel to the base bottom wall; and the lid having a surface cap, an inverted U-shaped section connected to the lid surface cap, and an annular flange extending from the lid inverted U-shaped section such that the lid annular flange extends in a plane generally parallel to the lid surface cap;

wherein the base and lid inverted U-shaped sections are sized such that, when mounted to one another, the base and lid annular flanges abut one another;

wherein the lid and base inverted U-sections each have projections that together provide a deformable detent mechanism for releasably locking the lid to the base;

wherein the cross-sectional thickness of a first junction between the base annular flange and the base inverted U-section is narrower than the cross-sectional thickness of a wall that provides the base inverted U-section; and wherein the cross-sectional thickness of a second junction between the lid annular flange and the lid inverted U-section is narrower than the cross-sectional thickness of a wall that provides the lid inverted U-section;

wherein the first junction between the base annular flange and the base inverted U-section defines a corner and the second junction between the lid annular flange and the lid inverted U-section is located radially outward of the first junction so as to enable the base and lid annular flanges to be torn away from the base and lid inverted U-shaped sections along different parting lines.

2. A container according to claim 1, wherein:

the base inverted U-shaped section comprises a first sidewall portion connected to the base sidewall, a bight portion, and a second sidewall portion connected to the base annular flange, the base projection depending from the second sidewall portion;

the lid inverted U-shaped section comprises a first sidewall portion connected to the lid surface cap, a bight portion, and a second sidewall portion connected to the lid annular flange, the lid projection depending from the second sidewall portion; and the base projection abuts against the lid second sidewall portion causing the base first sidewall portion to abut and seal against the lid first sidewall portion.

3. A container according to claim 1, wherein the base and lid annular flanges are bonded to one another.

4. A container according to claim 2, wherein:

the base second sidewall portion is substantially linear and the base projection extends outwardly therefrom;

the lid second sidewall portion is substantially linear and the lid projection extends outwardly therefrom; and the lid projection is situated underneath the base projection when the lid is mounted on the base.

5. A container according to claim 1, including a pull tab connected to at least one of the base and lid annular flanges.

6. A container according to claim 1, wherein the base and the lid are formed from polypropylene.

* * * * *